US010780335B1

(12) United States Patent
Smith

(10) Patent No.: US 10,780,335 B1
(45) Date of Patent: Sep. 22, 2020

(54) CONTACT LOCATION IDENTIFICATION APPARATUS AND METHOD

(71) Applicant: Troy James Smith, Diamondhead, MS (US)

(72) Inventor: Troy James Smith, Diamondhead, MS (US)

( * ) Notice: Subject to any disclaimer, the term of this patent is extended or adjusted under 35 U.S.C. 154(b) by 0 days.

(21) Appl. No.: 16/256,068

(22) Filed: Jan. 24, 2019

Related U.S. Application Data

(60) Provisional application No. 62/621,617, filed on Jan. 25, 2018.

(51) Int. Cl.

| | |
|---|---|
| ***A63B 69/00*** | (2006.01) |
| ***A63B 71/06*** | (2006.01) |
| *A63B 63/00* | (2006.01) |
| *A63B 69/36* | (2006.01) |
| *A63B 5/02* | (2006.01) |
| *A63B 43/02* | (2006.01) |

(52) U.S. Cl.
CPC ..... *A63B 71/06* (2013.01); *A63B 5/02* (2013.01); *A63B 43/02* (2013.01); *A63B 63/00* (2013.01); *A63B 69/002* (2013.01); *A63B 69/0002* (2013.01); *A63B 69/3617* (2013.01); *A63B 2071/0694* (2013.01)

(58) Field of Classification Search
CPC ..... A63B 69/3617; A63B 69/002; A63B 69/0024; A63B 69/3685; A43B 23/00; A43B 5/02; A43B 3/0078
USPC ..... 473/422, 450, 458, 464, 438, 446, 200, 473/452, 237; 36/133, 136, 128, 114, 36/139; D2/906, 902, 896, 964; D21/683, 685
See application file for complete search history.

(56) References Cited

U.S. PATENT DOCUMENTS

| | | | | | |
|---|---|---|---|---|---|
| 1,572,527 | A * | 2/1926 | Goldsworthy | A63B 69/3617 | 473/280 |
| 1,842,944 | A * | 1/1932 | O'Brien | A63B 69/3655 | 473/200 |
| 2,311,546 | A * | 2/1943 | Hurt | A63B 59/40 | 473/529 |
| 2,660,436 | A * | 11/1953 | Grossman | A63B 69/3617 | 473/237 |
| 3,071,379 | A * | 1/1963 | Ramsey | A63B 69/3617 | 473/237 |
| 3,401,941 | A * | 9/1968 | Hesidence | A63B 69/3632 | 473/235 |
| 3,754,764 | A * | 8/1973 | Manheck | A63B 69/0024 | 473/237 |
| 3,806,132 | A * | 4/1974 | Brandell | A63B 69/3617 | 473/237 |
| 4,204,346 | A * | 5/1980 | Fugere | A43B 5/02 | 473/446 |
| 4,711,043 | A * | 12/1987 | Johnson | A43B 23/00 | 473/446 |
| 4,917,384 | A * | 4/1990 | Caiati | A63B 53/04 | 473/330 |

(Continued)

*Primary Examiner* — Mitra Aryanpour
(74) *Attorney, Agent, or Firm* — J. Nevin Shaffer, Jr.

(57) ABSTRACT

A contact location identification apparatus and method consists of a marking device with a first side and a second side. An attachment device is connected with the first side, where the attachment device removably attaches to an object. A marking receptor surface is provided on the second side, where the marking receptor surface holds a transferable marker substance.

18 Claims, 4 Drawing Sheets

(56) References Cited

U.S. PATENT DOCUMENTS 5,033,746 A * 7/1991 Jones ..... A63B 69/3617 473/237
5,120,358 A * 6/1992 Pippett ..... A63B 69/3617 473/237
5,142,309 A * 8/1992 Lee ..... A63B 69/3617 473/237
5,216,827 A * 6/1993 Cohen ..... A43B 5/02 473/446
5,290,043 A * 3/1994 Vidinic ..... A43B 3/0078 473/446
5,433,437 A * 7/1995 Dudley ..... A63B 69/002 36/139
5,570,883 A * 11/1996 Csabai ..... A63B 51/10 473/543
5,779,556 A * 7/1998 Cervantes ..... A63B 69/3617 473/237
5,830,077 A * 11/1998 Yavitz ..... A63B 69/3617 473/226
5,897,446 A * 4/1999 Wiseman ..... A43B 5/02 473/446
5,947,845 A * 9/1999 Canelas ..... A43B 5/02 473/446
7,134,967 B2 * 11/2006 Lester ..... A63B 69/3617 473/237
7,172,521 B1 * 2/2007 Novis ..... A63B 69/002 473/422
7,497,035 B2 * 3/2009 Kos ..... A43B 1/0081 36/128
10,471,315 B2 * 11/2019 Jessup ..... A63B 57/00 401/62
2005/0085310 A1 * 4/2005 Murray ..... A63B 69/3617 473/200
2005/0144812 A1 * 7/2005 Wheeler ..... A43B 3/0078 36/133
2006/0211522 A1 * 9/2006 Hapanowicz ..... A63B 69/0002 473/452
2007/0227047 A1 * 10/2007 Zaza ..... A43B 1/0027 36/133
2008/0153632 A1 * 6/2008 Flores ..... A43B 1/0027 473/446

* cited by examiner

CONTACT LOCATION IDENTIFICATION APPARATUS AND METHOD

CROSS REFERENCE TO RELATED APPLICATION

This application claims the benefit of previously filed U.S. provisional patent application No. 62/621,617 filed Jan. 25, 2018 for a "Contact Location Identification Apparatus and Method". The Applicant hereby claims the benefit of this provisional application under 35 U.S.C. § 119. The entire content of this provisional application is incorporated herein by this reference.

FIELD OF THE INVENTION

This invention relates to a contact location identification apparatus and method. In particular, in accordance with one embodiment, the invention relates to a contact location identification apparatus consisting of a marking device with a first side and a second side. An attachment device is connected with the first side, where the attachment device removably attaches to an object. A marking receptor surface is provided on the second side, where the marking receptor surface holds a transferable marker substance.

BACKGROUND OF THE INVENTION

A problem exists with regard to making consistent contact with objects. By way of example only and not by limitation, kicking a ball, football, soccer, etc., accurately is difficult and requires many hours of practice. Troubleshooting can be very difficult due to the complexity of a technique in which the entire body is involved. Endless repetition and observation with minimal physical feedback is the current state of the art.

Thus, there is a need in the art for a device that enhances the user's ability to become proficient and consistent when practicing hitting an object. Further there is a need for a device that is not cumbersome to use or complicated to understand the results provided. Still further, there is a need for a device that does not require electronic devices and yet which provides immediate physical feedback to a user such that a user can actually see where an object was contacted.

It therefore is an object of this invention to provide a contact location identification apparatus and method that is applicable to many types of environments and activities such as soccer, football, and the like, that is easy to use and reuse and is adjustable and configurable in many designs.

SUMMARY OF THE INVENTION

Accordingly, the present invention, according to one embodiment, includes a contact location identification apparatus consisting of a marking device with a first side and a second side. An attachment device is connected with the first side, where the attachment device removably attaches to an object. A marking receptor surface is provided on the second side, where the marking receptor surface holds a transferable marker substance.

All terms used herein are given their common, ordinary meaning such that "attachment device" describes a device used to connect one thing with another. In this case, the preferred attachment device is removably attachable to an object by means of any desirable process such as with glue, hook and loop material, etc. Likewise, "transferable marker substance" describes a substance that after application to one thing, is at least partially transferred, after contact, to another thing. As discussed more fully hereafter, one such preferred substance is chalk and another is dry erase marker.

In another aspect, the object is a shoe.

In one aspect, there are more than one marking device and, in another aspect, the more than one marking devices are arranged in a pattern. In a further aspect, the pattern is located on a shoe.

In another aspect, the marking receptor surface consists of two parts: an adhesive surface and a removable marking surface where the removable marking surface is removably attached to the adhesive surface. In one aspect, the removable marking surface is sand paper.

According to another embodiment, a contact location identification apparatus consists of a flexible marking device with a first side and a second side, a length, a width and a height where the height is small compared to the length and width such that the flexible marking device is thin. The term "thin" is given its common meaning as, again, are all terms used herein. As a result, as used herein, the apparatus is thin when compared to the object to which it is attached, such as a shoe, for example. That is, once applied, the apparatus conforms to the surface to which it is attached and extends only a small distance away from the surface to which it is attached. An attachment device is connected with the first side where the attachment device removably attaches to a surface of an object and supports the second side at a distance equal to the height of the flexible marking device away from the surface of the object. A marking receptor surface is provided by/on the second side of the flexible marking device where the marking receptor surface holds a transferable marker substance.

In one aspect, the transferable marker substance is selected from a group consisting of: chalk and dry erase material.

In another aspect, the apparatus further includes more than one marking device and where the more than one marking devices are arranged in a pattern. As used herein, the term "pattern" describes an arrangement consisting of more than one marking device separated from each other and individually situated on a shoe, for example only and not by limitation.

In one aspect, the marking receptor surface consists of an adhesive surface and a removable marking surface where the removable marking surface is removably attached to the adhesive surface. In one aspect, the removable marking surface is sand paper.

According to another embodiment, a contact location identification method consists of:

a. providing a marking device with a first side and a second side; an attachment device connected with said first side where the attachment device removably attaches to an object; and a marking receptor surface on the second side where the marking receptor surface holds a transferable marker substance;

b. attaching the attachment device to an object; and c. adding the transferable marker substance to the marking receptor surface.

In one aspect, the method further includes causing the marking receptor surface to contact a second object such that at least some of the transferable marker substance is transferred to the second object.

In another aspect, more than one marking device is provided and in another aspect the more than one marking devices are arranged in a pattern on the object.

In a further aspect, the marking receptor surface consists of an adhesive surface and a removable marking surface where the removable marking surface is removably attached to the adhesive surface.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
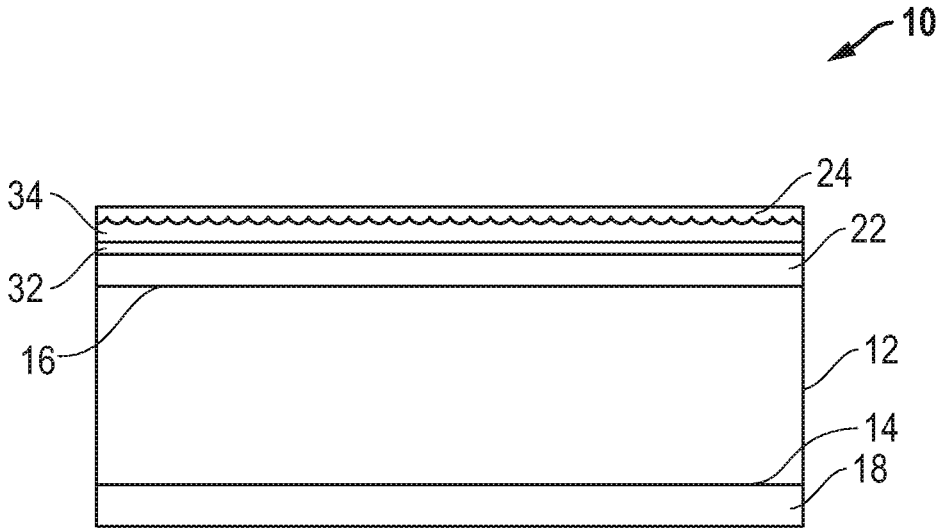
FIG. 1 is a side schematic view of the contact location identification apparatus of the present invention.
Figure 2:
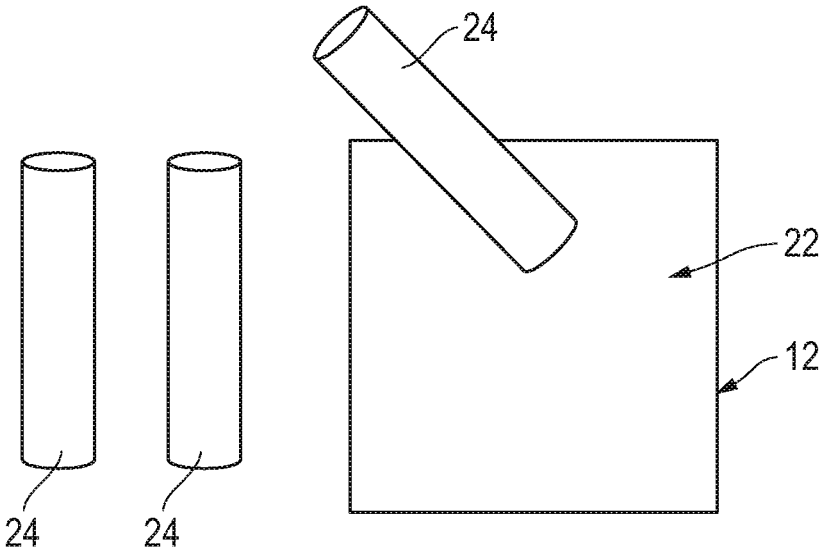
FIG. 2 is a top view of the invention of FIG. 1 showing chalk added to sand paper.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described process may be altered so that certain processes are conducted in parallel or independent, with other processes, to the extent that the processes are not dependent upon each other. Thus, the specific order of steps described herein is not to be considered implying a specific sequence of steps to perform the process. In alternative embodiments, one or more process steps may be implemented by a user assisted process and/or manually. Other alterations or modifications of the above processes are also contemplated.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

The preferred embodiment of the present invention is illustrated by way of example in FIGS. 1-6. With specific reference to FIGS. 1 and 2, contact location identification apparatus 10 includes a marking device 12 with a first side 14 and a second side 16. An attachment device 18 is connected with the first side 14, where the attachment device 18 removably attaches to an object 20 (not shown, see FIGS. 3 and 4). A marking receptor surface 22 is provided on the second side 16, where the marking receptor surface 22 holds a transferable marker substance 24. In one aspect, the transferable marker substance 24 is common chalk but any transferable marker substance 24, such as dry erase material for example only and not by limitation, now known or hereafter developed is included within the scope of the invention.

It should be clear that the marking receptor surface 22 of second side 16 of marking device 12 may simply be the surface of the marking device 12 to which transferable marker substance 24 is applied. Applicant, however, has found that the preferred embodiment is to provide a removable marking surface 34 with a rough surface, such as sand paper for example only and not by way of limitation, to the second side 16. In this embodiment, the structure of marking surface 22 consists of an adhesive surface 32 as the first surface on second side 16. On top of that is placed a removable marking surface 34 to which transferable marker substance 24 is applied. Preferably, again, removable marking surface 34 includes a rough surface. Applicant has found that this rough surface markedly and surprisingly holds the transferable marker substance 24 better and enhances the transference of at least some of the transferable marker substance 24. Importantly, as the removable marking surface 34, sand paper, wears down, it is easily replaced with fresh sand paper, for example only.

Further, Applicant has found that marking device 12 is preferably "flexible", as that term is commonly understood, such that it readily conforms to both the surface of an object 20 to which it is attached and also more effectively molds itself to the surface of an object struck, second object 28. Plastic tape, or any flexible material now known or hereafter developed, is appropriate for the purpose of the invention. Additionally, Applicant has found it is important that the marking device 12 be "thin" such that it does not extend far from the surface of the object to which it is attached, object 20, such that it causes interference with contacting the second object 28. The thin marking device 12 therefore more readily conforms to the surface of the object to which it is attached, object 20, and also results in a more authentic contact with the item struck, second object 28. The term "thin" is used herein as commonly understood by those of ordinary skill.

Figure 3:
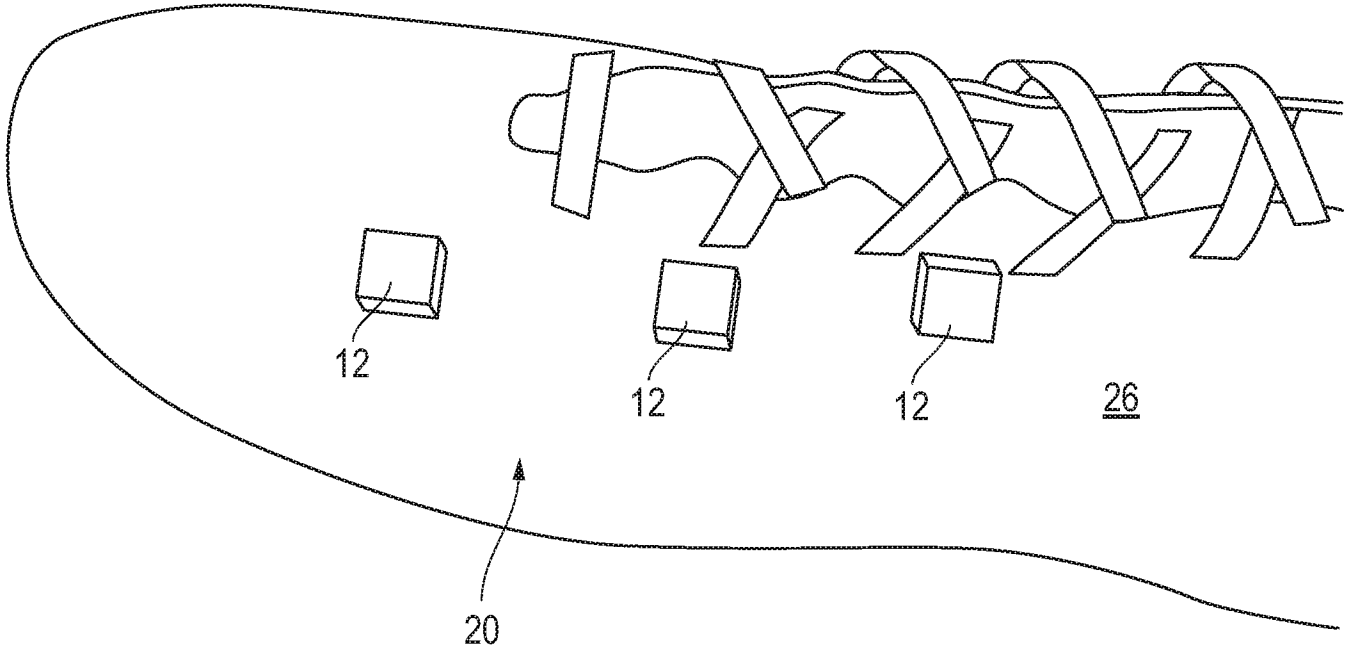
FIG. 3 is a side view of the invention of FIG. 1 shown in a pattern of three separate sections attached to an athletic shoe.

Referring now to FIG. 3, Applicant has found that multiple marking devices 12, trimmed to one-quarter inch squares, for example only and not by way of limitation, and attached separately to object 20, such as athletic shoe 26 for example only and not by limitation, provides highly useful physical information as to the exact contact location of each marking device 12 on second object 28. That is, the "pattern" on the shoe 26 is reproduced on the ball, football 30 and/or soccer ball 32, for example only, such that a much more exact idea of where the user's foot was positioned at the moment of contact is provided. Again, preferably, in one aspect, the device utilizes three separate marking devices 12 individually, in a line pattern as shown, for example only, attached to athletic shoe 26 at user selected locations. Applicant has found that where the three marking devices 12 include different colored transferable marker substance 24 even more information is obtainable as a more accurate indication of just which part of the shoe contacted the ball most. Certainly, a single long section of the invention may be used or any other combinations and patterns created as deemed useful.

Figure 4:
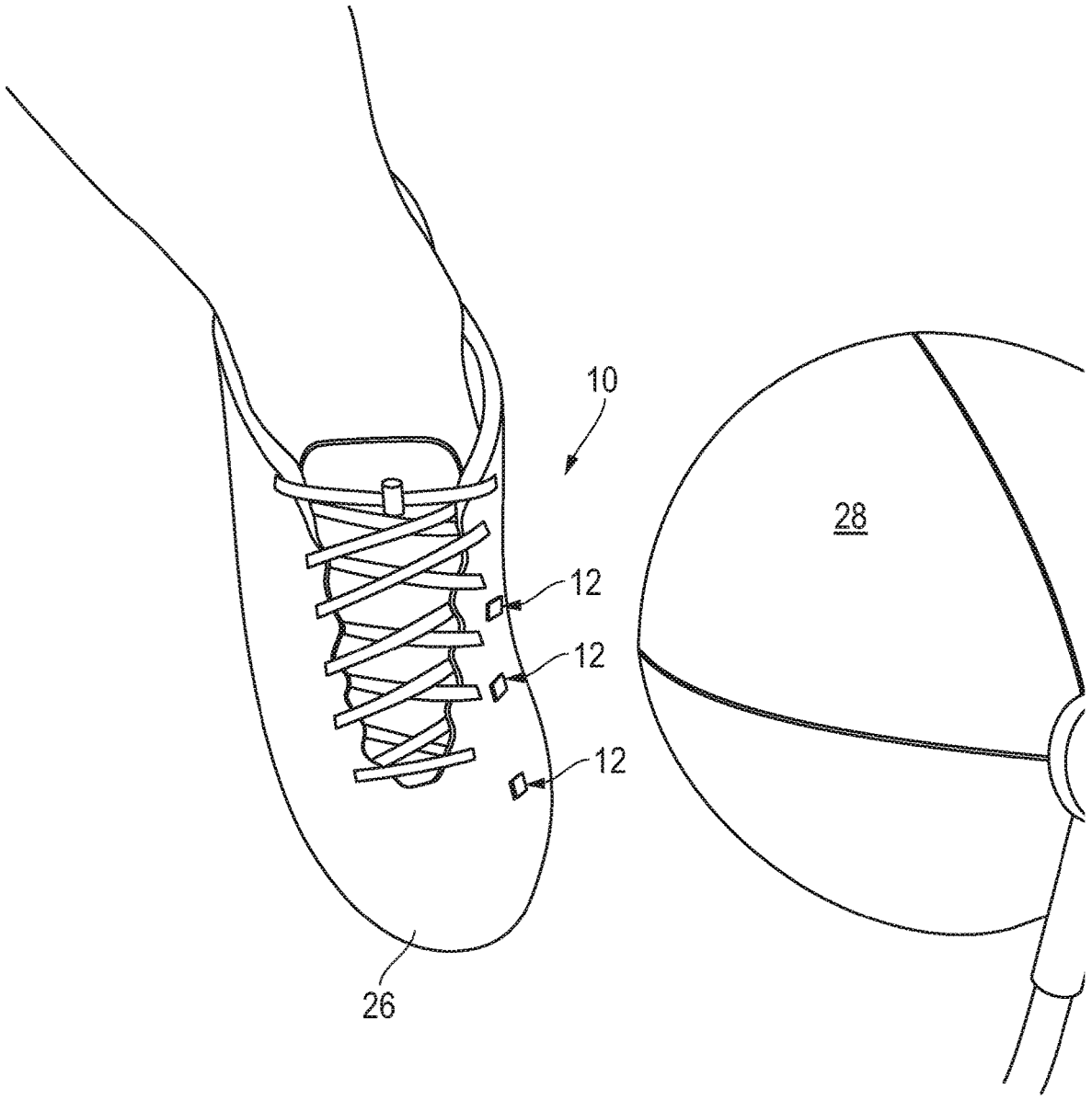
FIG. 4 is a top view of the invention of FIG. 3 shown prior to contact with a football.
Figure 5:
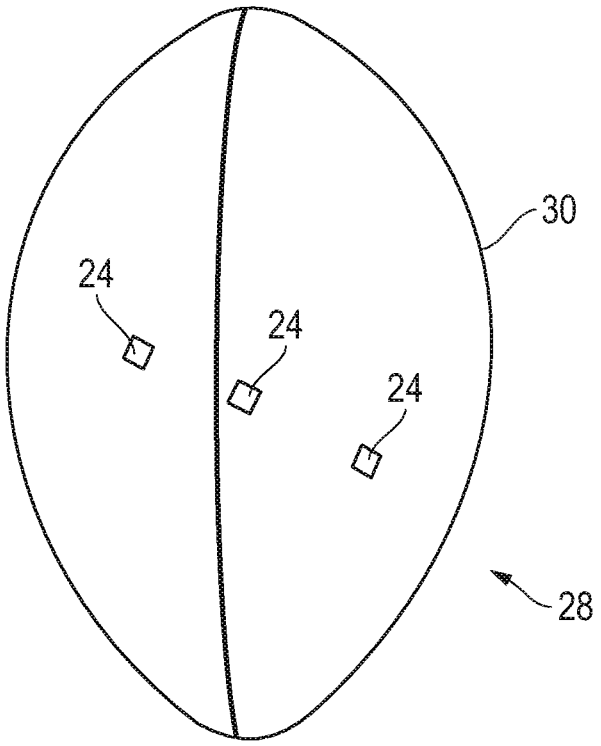
FIG. 5 is a side view of the football of FIG. 4 illustrating the transfer of some of the chalk from the marking receptor surface to the football.
Figure 6:
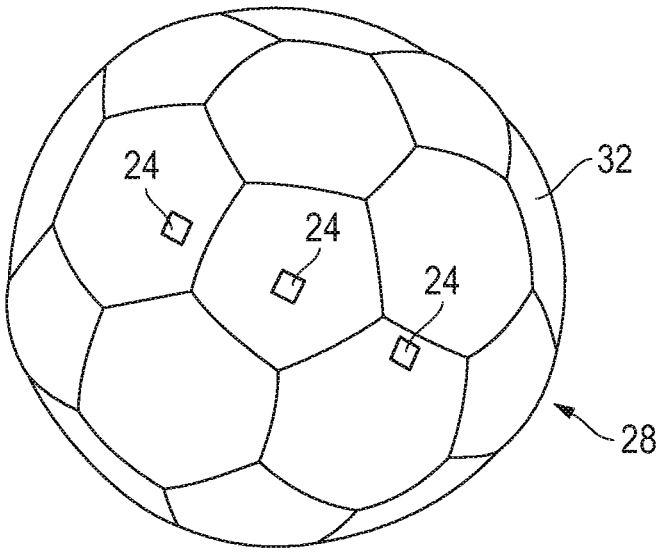
FIG. 6 is a side view of illustrating the use of the invention of FIG. 1 to transfer some of the transferable marker substance to the surface of a soccer ball.

FIG. 4 shows the athletic shoe 26 of FIG. 3 in close proximity to second object 28, in this example, football 30. FIG. 5 shows the result of the use of the contact location identification apparatus 10 of the present invention, with a series of three separate, in this case different colored, marks are deposited on football 30 showing exactly where the user's athletic shoe 26 contacted football 30. FIG. 5 shows the results of the use of the present invention to transfer transferable marker substance 24 to the surface of a football 30 and FIG. 6 shows the same result when a soccer ball 32 is struck.

It is a simple matter to make contact location identification apparatus 10 ready for reuse by applying more transferable marker substance 24, chalk, etc., to the second side 16, marking receptor surface 22. Also, the user simply wipes the chalk off the object 20 and second object 28, football 30 or soccer ball 32, in preparation for the next kick. In total, the contact location identification apparatus 10 allows an athlete to understand where he or she made contact with the ball and, importantly, what part of his or her foot was used to make contact. This vital information has never been able to be accurately determined, except by means of expensive electronic equipment, prior to the present invention. Importantly, contact location identification apparatus 10 is adjustable from broad to narrow fields of information depending on the skill level of the user. That is, for beginners, one large marking device 12 is used to determine the main point of contact. As the user's skill levels increase, multiple marking devices 12 may be used to ensure the best possible contact location for the best possible results, as desired.

In use, Applicant prefers the use of flexible, thin, double sided adhesive tape as the marking device 12. In one aspect, an aerosol adhesive is applied to the second side 16 and then sand paper is cut to fit and placed on second side 16. Chalk or the like is then rubbed on to the sand paper which, subsequently, leaves a mark on the football 30/soccer ball 32 after the apparatus is attached to the athletic shoe 26 and the ball 30/32 is struck. Obviously, the user may choose differing sizes of marking device 12 and different numbers and locations, all as deemed useful.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A training device attachable to a sports shoe, the device comprising:

two or more marking devices, each having a shape and a size, a first side and a second side, wherein each of the two or more marking devices are removably positioned on the sports shoe in a pre-determined pattern;

each of the two or more marking devices further comprising:

an attachment device attached to the first side of each of the two or more marking device, wherein the attachment device removably attaches each of the two or more marking devices to the sports shoe in the pre-determined pattern; and a receptor positioned on the second side of the two or more marking devices, wherein the receptor is configured for holding a transferable marker substance such that the transferable marker substance transfers a pre-determined pattern on the ball when the sports shoe impacts the ball.

2. The apparatus of claim 1 wherein said transferable marker substance is chalk.

3. The apparatus of claim 1 wherein said transferable marker substance is dry erase material.

4. The apparatus of claim 1 wherein each of the two or more marking devices are rectangular in shape.

5. The apparatus of claim 1 wherein said receptor consists of an adhesive surface and a marking surface, wherein said marking surface is removably attached to said adhesive surface.

6. The apparatus of claim 1 wherein said marking surface is sand paper.

7. A training device attachable to a sports shoe, the device comprising:

two or more marking devices, each having a shape and a size, a first side and a second side, wherein each of the two or more marking devices are positioned on the sports shoe in a linear pattern;

each of the two or more marking devices further comprising:

an attachment device attached to the first side of each of the two or more marking devices, wherein the attachment device, removably attaches each of the two or more marking devices to the sports shoe in a linear pattern; and a receptor positioned on the second side of the two or more marking device, wherein the receptor is configured for holding a transferable marker substance such that the transferable marker substance transfers the linear pattern on the ball when the sports shoe impacts the ball.

8. The apparatus of claim 7 wherein said transferable marker substance is selected from a group consisting of; chalk and dry erase material.

9. The apparatus of claim 7 wherein said receptor consists of an adhesive surface and a marking surface, wherein said marking surface is removably attached to said adhesive surface.

10. A method for training a user, the method comprising the steps of:

providing two or more marking devices, each having a shape and a size, a first side and a second side, wherein each of the two or more marking devices are positioned on the sports shoe in a pre-determined pattern;

each of the two or more marking devices further comprising:

an attachment device and a receptor;

removably attaching the attachment device to the first side of each of the two or more marking devices;

removably attaching a second side of each of the attachment devices to the sports shoe;

positioning a receptor on the second side of each of the two or more marking devices;

arranging each of the two or more marking devices on the sports shoe in a pre-determined pattern;

applying a transferable marker substance to each of the receptors;

impacting with the sports shoe a ball such that the transferable marker substance transfers the pre-determined pattern on the ball when the sports shoe comes into contact with the ball.

11. The method of claim 10 wherein said receptor consists of an adhesive surface and a marking surface, wherein said marking surface is attached to said adhesive surface.

12. The apparatus of claim 1 wherein the two or more marking devices are three marking devices.

13. The apparatus of claim 12 where each of the three marking devices has a color different from the other two marking devices.

14. The apparatus of claim 10 wherein the two or more marking devices are three marking devices.

15. The apparatus of claim 10 where each of the three marking devices has a color different from the other two marking devices.

16. The apparatus of claim 7 wherein each of the two or more marking devices are rectangular in shape.

17. The apparatus of claim 1 wherein the ball is selected from a group of balls consisting of: soccer balls and footballs.

18. The apparatus of claim 7 wherein the ball is selected from a group of balls consisting of: soccer balls and footballs.

* * * * *